United States Patent [19]

Weber

[11] 3,968,484

[45] July 6, 1976

[54] SPRING-ACTUATED SECURITY ALARM FOR A DOOR

[75] Inventor: Frank X. Weber, Bronx, N.Y.

[73] Assignee: Lawrence Peska Associates, Inc., New York, N.Y. ; a part interest

[22] Filed: Mar. 19, 1975

[21] Appl. No.: 559,966

[52] U.S. Cl. ..... 340/274 R; 200/61.82; 200/61.93

[51] Int. Cl.[2] ..... G08B 13/08

[58] Field of Search ..... 200/61.82, 61.8, 61.93; 340/274 R

[56] References Cited

UNITED STATES PATENTS

| | | | |
|---|---|---|---|
| 2,281,193 | 4/1942 | Hollingsworth | 200/61.8 |
| 3,029,425 | 4/1962 | Forrester | 340/274 R |
| 3,567,882 | 3/1971 | Beck | 200/61.93 |

*Primary Examiner*—Glen R. Swann, III
*Attorney, Agent, or Firm*—Richard Nanfeldt

[57] ABSTRACT

A security alarm device includes a housing of an electrically conductive material having a horizontal bottom base, a pair of upwardly extending end walls; a front face, and an upper end. An elongated rod member of an electrically conductive material having a threaded outer surface threadably engages a threaded hole in the bottom base and an opening in the top, wherein an end of an elongated bar member is affixed into a center transverse aperture of the rod member. An electric contact point within the housing communicates with bar member as it rotates within the housing causing the electric series circuit of the security alarm device to open and close. The series circuit of the security alarm device consists of a power source, an on/off switch, an alarm, the contact point, the housing, the rod member and the bar member. A mounting plate affixed onto the housing is adapted to be received by the door frame. The other end of the bar member protrudes through a slot aperture in the front face of the housing and is adapted to communicate with an inwardly swinging door.

5 Claims, 3 Drawing Figures

SPRING-ACTUATED SECURITY ALARM FOR A DOOR

SUMMARY OF THE INVENTION

My invention relates to a unique and novel security alarm device for a door.

A number of U.S. patents: Nos. 2,824,185; 3,179,766; 3,453,613; 3,530,262; and 3,715,537 have employed security alarm devices for doors and windows, but these aforementioned patents are non-applicable to my present invention.

An object of my present invention is to provide a security alarm device adaptable to either a door or a window assembly.

A further object of my present invention is to provide a security alarm device of simple design and relatively low manufacturing cost.

Briefly, my present invention comprises a housing of an electrically conductive material having a horizontal bottom base, a pair of upwardly extending end walls; a front face, and an upper end. An elongated rod member of an electrically conductive material having a threaded outer surface threadably engages a threaded hole in the bottom base and a opening in the top, wherein an end of an elongated bar member is affixed into a center transverse aperture of the rod member. An electric contact point within the housing communicates with bar member as it rotates within the housing causing the electric series circuit of the security alarm device to open and close. The series circuit of the security alarm device consists of a power source, an on/off switch, an alarm, the contact point, the housing, the rod member and the bar member. A mounting plate affixed onto the housing is adapted to be received by the door frame. The other end of the bar member protrudes through a slot aperture in the front face of the housing and is adapted to communicate with an inwardly swinging door.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
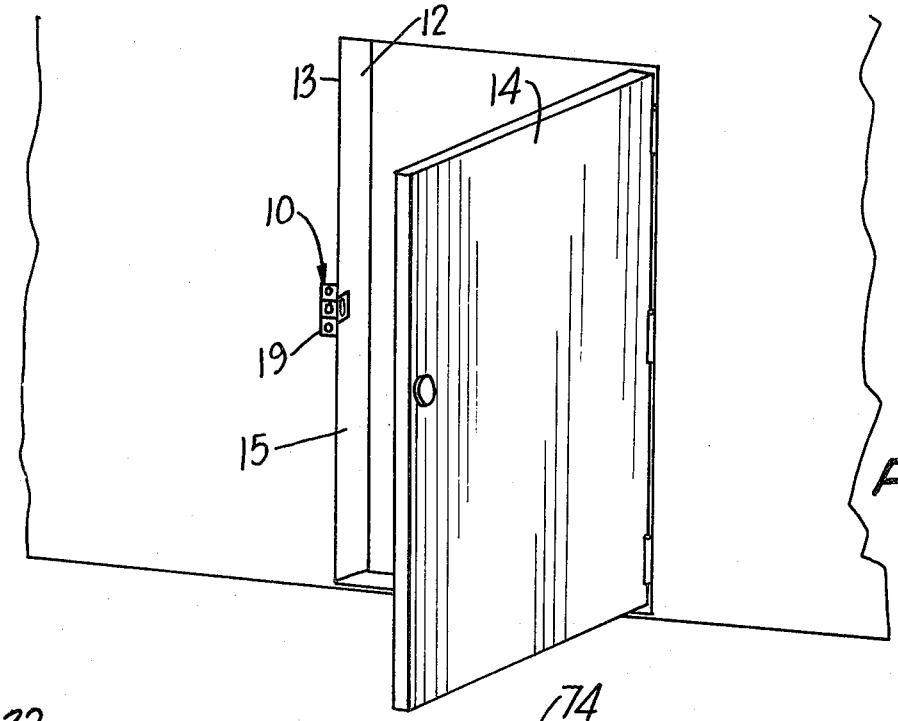
FIG. 1 illustrates a front perspective view of a security alarm device affixed onto a door frame.

Turning now descriptively to the drawings, in which similar reference characters denote similar elements throughout the several views:

FIG. 1 shows a security alarm device 10 mounted into a cutout in a door frame 12 for an inwardly swinging door 14.

Figure 2:
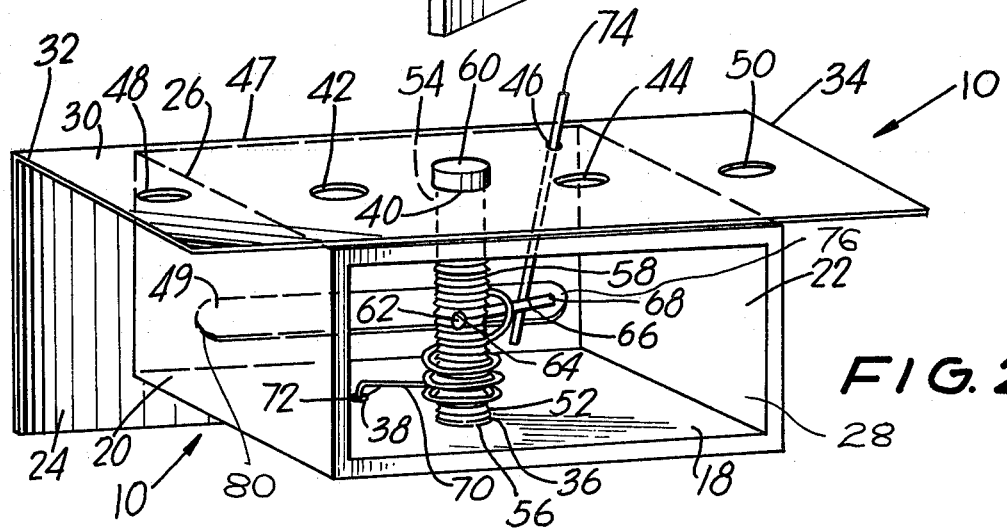
FIG. 2 illustrates a rear perspective view of the security alarm device.
Figure 3:
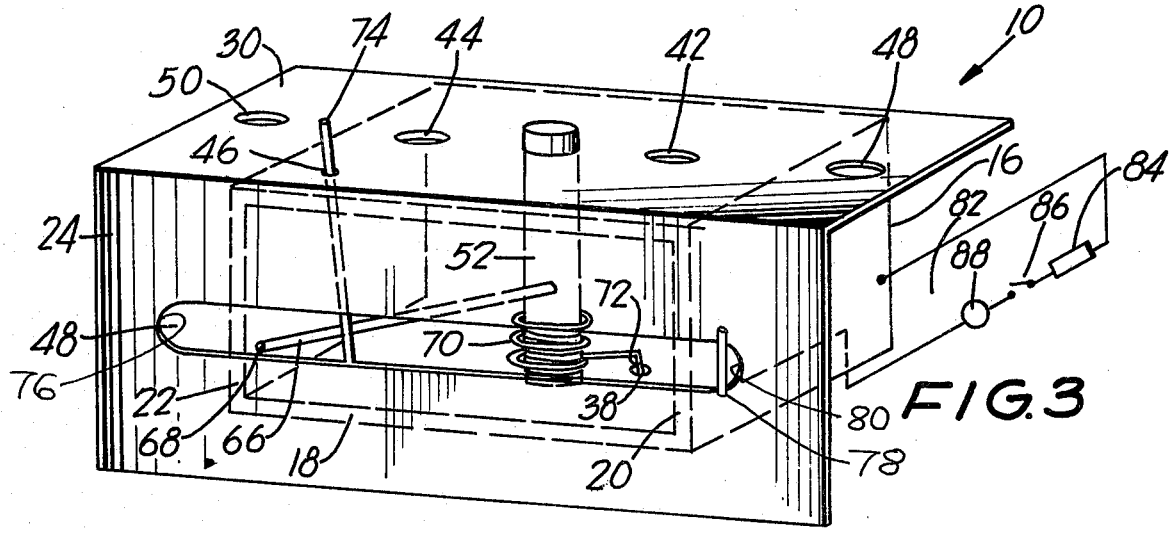
FIG. 3 illustrates a front perspective view of the security alarm device.

FIGS. 2–3 show the security alarm device 10, which comprises a rectangular shaped housing 16 of an electrically conductive material having a bottom base 18, a pair of upwardly extending end walls 20, 22, an upwardly extending front face 24 which extends beyond end walls 20, 22, a top 26, and an open rear face 28. An elongated rectangular shaped plate 30 of non-conductive material is affixed flush onto the upper surface of the upper end 26, wherein the distal ends 32, 34 of plate 30 extend beyond the end walls 20, 22 of housing 16. The bottom base 18 has a central large threaded hole 36 therethrough as well as a small pin hole 38 therethrough. The top 26 in combination with plate 30 has a central opening 40 therethrough as well as a pair of circular apertures 42, 44 therethrough, wherein the apertures 42, 44 are positioned midway between opening 40 and end walls 20, 22 along a longitudinal median of plate 30. The top 26 and plate 30 also has a small aperture 46 therethrough aligned laterally with aperture 44 near the front longitudinal edges 47 of upper end 20 and plate 30. The distal ends 32, 34 of plate 30 extending beyond end walls 20, 22 have circular holes 48, 50 therethrough. The front face 24 of housing 16 has a longitudinally aligned slot aperture 49 therethrough. Opening 40 and hole 36 are aligned on an imaginary axis. The ends 54, 56 of an elongated rod member 52 of electrically conductive material having a threaded outer surface 58 threadably engages the opening 40 and hole 36, wherein the upper end 54 of rod member 52 protrudes above plate 30. A knob member 60 is affixed onto end 54 above plate 30. The center of rod member 52 has a transverse aperture 62 therethrough. One end 64 of an elongated bar member 66 of an electrically conductive material is embedded into aperture 62, wherein member 66 relates in a horizontal plane as rod member 44 is turned. The other end 68 of bar member 66 protrudes through slot aperture 49. A tension spring 70 is wound onto rod member 52, wherein a free end 72 of spring 70 is anchored into pinhole 38 of the bottom base 18. An elongated pin 74 inserts through aperture 46 to engage bar member 66 at one end 76 of slot aperture 49, thereby restricting the rotation of bar member 66. An electric contact point 78 is contained at the other end 80 of slot aperture 49, wherein bar member 66 rotates in aperture 49 to make electrical contact with contact point 78, when the pin 74 is moved from the security device 10. The electric series circuit 82 of the device 10 consists of a power source 84, an on/off switch 86, an alarm 88, the contact point 78, the bar member 66, the rod member 52, and the housing 16. An alternate embodiment of the present invention is to wire the power source 84 directly to the tension spring 70 instead of the housing 16 as in the preferred embodiment.

Referring back to FIG. 1, the security alarm device 10 is mounted into the cutout in the door frame 12 such that plate 30 is mounted onto the interior face 13 of frame 12 by screw members 19 passing through holes 48, 50 and the front face 24 of housing 16 aligns flush on the interior jamb 15 of the door frame 12.

The pin 74 is inserted into the device 10 so as to restrict rotation of bar member 66, wherein the electric circuit is open. The door 14 is closed wherein the door 14 engages the other end 68 of bar member 66, whereby the rotation of bar member 66 is further hindered. The pin 74 is removed from the device 10. If the door 14 is opened, the bar member 66 rotates and makes contact with 78, whereby the circuit is closed causing alarm 88 to be activated.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A security alarm device in combination with a door frame and door, which comprises:

a. a housing having a base, a pair of end walls, a top, and a front face with a longitudinally aligned slot aperture therethrough, said base having a central threaded hole therethrough as well as a small pinhole therethrough, and said top having a central circular-shaped therethrough and a small aperture therethrough;

b. a rod member of electrically conductive material having a threaded outer surface at one end, and a central transverse aperture therethrough, said threaded end of said rod member threadably engaging said threaded central hole, said other end of said rod member adapted to engage said central opening;

c. an elongated bar member of electrically conductive material having a pair of ends, one said end of said bar member affixed in said central transverse aperture, and the other end of said bar member protruding through said slot aperture adapted to engage said door, said bar member rotating in said slot aperture as said rod member rotates;

d. a mounting plate affixed onto said housing adapted to be mounted onto said door frame;

e. means tending to rotate said rod member and said attached bar member;

f. means for restricting rotation of said bar member; and g. an electrical series circuit consisting of said rod member, said bar member, a power source, an alarm, and a contact point cooperating with said bar member.

2. A security alarm device as recited in claim 1, wherein a tension spring is mounted on said rod member with one end embedded in said pinhole of said bottom base.

3. A security alarm device as recited in claim 2, wherein said mounting plate is a non-conductive material.

4. A security alarm device as recited in claim 1, wherein said means for restricting rotation comprises an elongated pin passing through said small aperture and engaging said bar member.

5. A security alarm device as recited in claim 1, wherein said housing is an electrically conductive material.

* * * * *